United States Patent [19]

Anderson

[11] 4,249,406

[45] Feb. 10, 1981

[54] LINE PIPE FORMING APPARATUS AND METHOD

[76] Inventor: Frohman C. Anderson, 3435 Sharps Lot Rd., Swansea, Mass. 02777

[21] Appl. No.: 939,700

[22] Filed: Sep. 5, 1978

[51] Int. Cl.[3] ..... B21C 37/06; B21D 39/02

[52] U.S. Cl. ..... 72/52; 72/171; 72/172; 72/174

[58] Field of Search ..... 72/51, 52, 146, 169, 72/170, 171, 172, 173, 174, 175, 368; 228/17.5, 147, 150, 151

[56] References Cited

U.S. PATENT DOCUMENTS

| | | | |
|---|---|---|---|
| 928,220 | 7/1909 | Schneider | 72/171 |
| 1,258,092 | 3/1918 | Clark | 72/171 |
| 1,303,849 | 5/1919 | Bryant | 72/171 |
| 1,968,455 | 7/1934 | Jones | 29/477 |
| 2,233,547 | 3/1941 | Miller et al. | 72/172 X |
| 2,868,265 | 1/1959 | Williams | 72/173 X |
| 3,285,490 | 11/1966 | Roper | 228/17.5 |
| 3,355,921 | 12/1967 | Pferdekamper | 72/51 X |
| 3,899,911 | 8/1975 | Ogier et al. | 72/169 |
| 4,000,636 | 1/1977 | Shubin et al. | 72/173 |

FOREIGN PATENT DOCUMENTS

| | | | |
|---|---|---|---|
| 620371 | 10/1935 | Fed. Rep. of Germany | 72/51 |
| 638323 | 11/1936 | Fed. Rep. of Germany | 72/170 |
| 1085839 | 7/1960 | Fed. Rep. of Germany | 72/170 |
| 1934884 | 3/1971 | Fed. Rep. of Germany | 72/170 |
| 30684 | 5/1960 | Finland | 72/51 |

*Primary Examiner*—Ervin M. Combs

*Attorney, Agent, or Firm*—Lowe, King, Price & Becker

[57] ABSTRACT

A machine and method for forming line pipe is disclosed wherein small diameter roll elements not exceeding five times the thickness of the blank form a tube. The roll elements positioned in a pyramid roll assembly are dynamically adjustable toward and away from each other to provide different size line pipe, or similar tubular articles. The segments of the upper roll elements are mounted on cantilever arms, the leading edge of blank being deflected against the upper curved surface of the arms during the final stages of forming. The deflection is maintained within the elastic recovery limit of the metal. A rigid frame mounts the cantilever arm and other components. The frame includes a plurality of vertical bed plates and corresponding upper frame plates and cross tie members. A pusher mechanism pushes the sheet blank through the pyramid roll assembly. A multi-walled tube may be formed by providing the required additional length to the blank and continuation of the forming beyond 360°. The blank is confined between idler rollers on the frame structures during forming. Special roller handling assemblies are provided for loading the blank and for unloading the finished tube from the machine.

40 Claims, 27 Drawing Figures

9
LM-8
M-5
M-5
M-5
84
85
LM-7
24
LM-7
LM-8
B
61
62
60
30
81
19
63a
63a
19
19
82
90
81
LM-3, LM-4
INFEED
81
91
30
LM-2
48d
48e
48e
47e
12
31
31
LM-5
48c
49
LM-10
48a
13
48b
25
LM-6
LM-1
39
36
9

30
48c
48d
38
47c
39
T2
31
LM-2
44
36
40
47d
48e
LM-1
48b
T1
47b
47e
50
51
45
55
49
18
100
12
13
11
B
36
16
73
18
103
15
56
23
22
LM-10
14
81
72
LM-6
LM-5
75
25
54
37
21
20

30
31
30
LM-2
48e
LM-7
LM-3
LM-4
M-2
90
91
22
30
19
90
22
B
90
81
91
91
82
83
84
60
85
LM-9
20
24
20
20
21
21

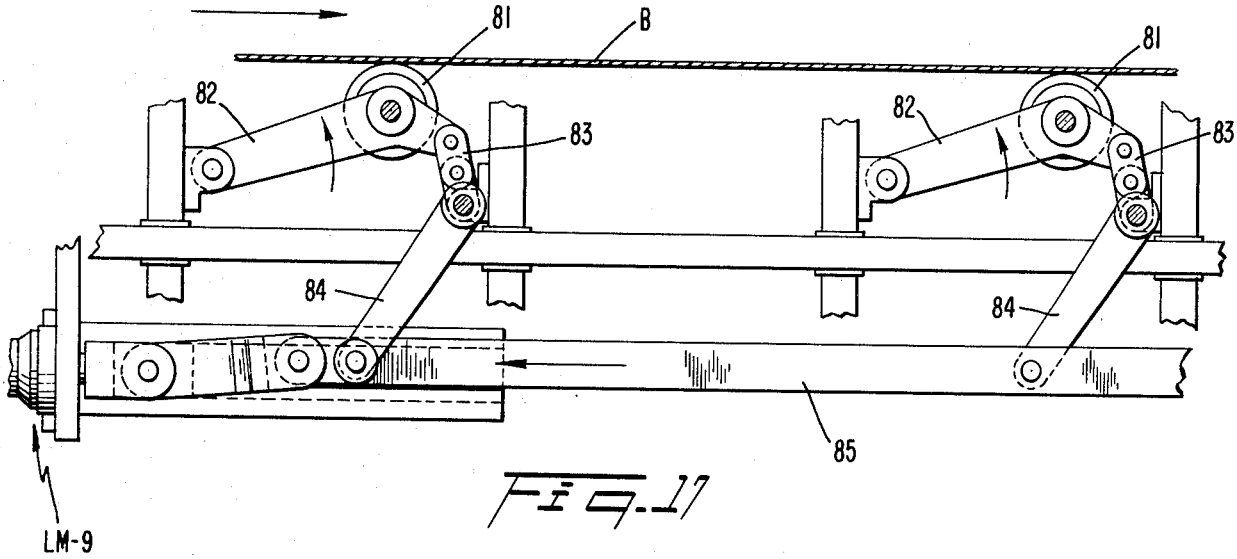
Fig. 17
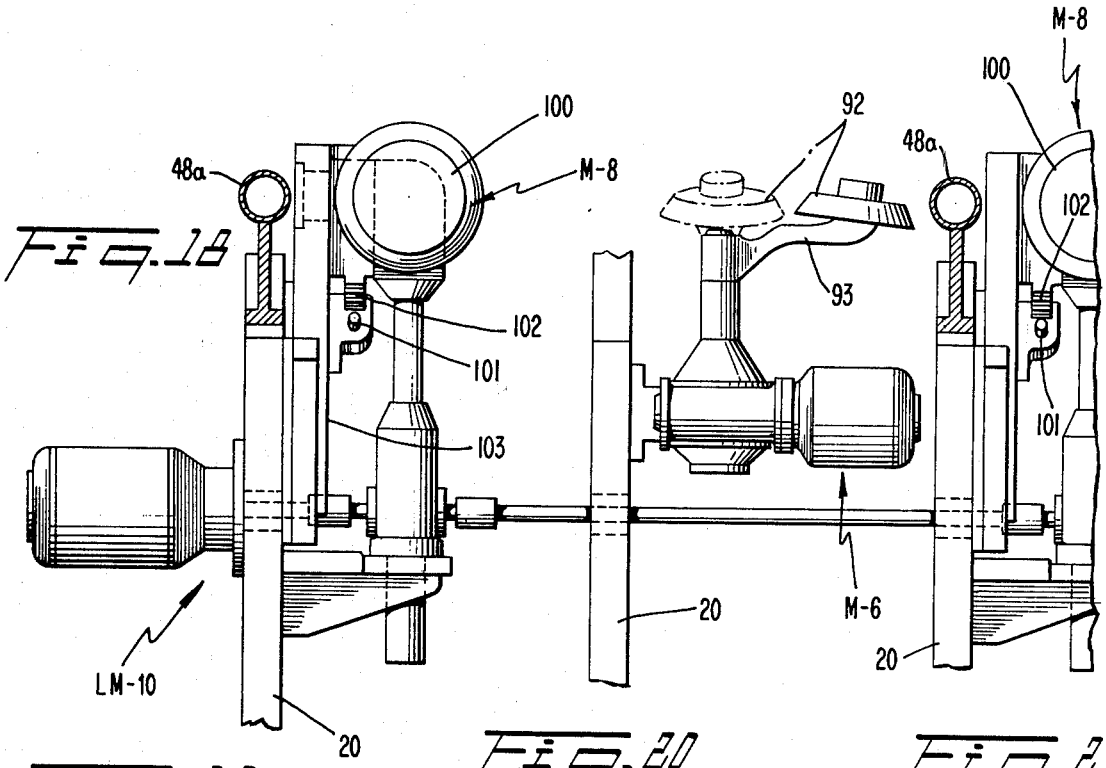
Fig. 18
Fig. 19
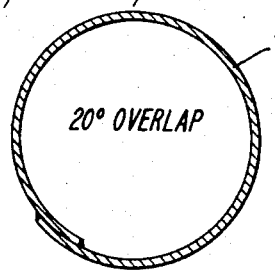
Fig. 20
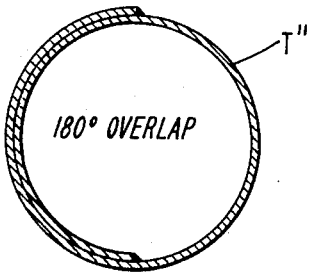
Fig. 21
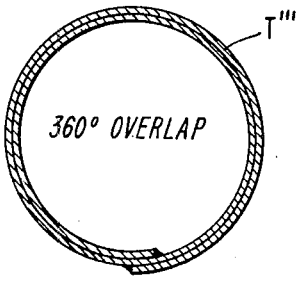

LINE PIPE FORMING APPARATUS AND METHOD

TECHNICAL FIELD

This invention relates to a machine for forming an elongated tubular body or pipe, particularly adapted for use as line pipe for transporting petroleum products, and other gases, slurries, liquids or the like, and more particularly, to a machine that is successful in forming a flat sheet or plate of steel into a tube of infinite number of selected diameters within a broad range, without internal mandrels, without any dies whatsoever and in one operation.

BACKGROUND ART

Large diameter line pipe in the order of 36 to 64 inch diameters makes possible the transport of petroleum products, such as crude oil, from the oil fields to storage tanks or to the refineries in a highly efficient manner. The oil is pumped at high pressures through the pipeline continuously regardless of the weather or any other factors, overland or off shore, hundreds or thousands of miles, a feat which cannot be equalled by any other method.

The efficient forming of line pipe for many years has been a subject of research of some of the world's most talented mechanical engineers, metallurgists and physicists. Attempts have been made to successfully form large diameter line pipe from metal sheet or plate in a single operation, but insofar as can be determined, none has been successful. Today, the most widely used method of forming line pipe involves a complicated, fivestep process known as the UOE process. In the UOE process, giant presses are utilized to convert a plate of steel into the tubular article. After machining the edges of the plate, the edges are first crimped; secondly, the plate is formed into a U; thirdly, the article is formed into an O utilizing an extremely large press; fourth, the article is seam welded; and, fifth, the article is expanded from within in an effort to minimize the out-of-round imperfections.

The presently used process is highly capital intensive. The cost of a complete facility has kept many companies, and even entire countries, from making line pipe, although there is an ever increasing need for such production. Furthermore, these installations produce pipe sections that leave much to be desired in terms of the physical geometry of the pipe. The longitudinal areas adjacent to the edges of the steel plate that come together for butt seam welding, tend to have "flats" along the entire length of the pipe. The extra crimping heavy press operation is an attempt to remove part of this difficulty, but this has not been totally successful. Also, sections of the pipe spaced approximately 30° to both sides of the seam tend to have detrimental compressive crystal dislocations adversely affecting the metal thickness. This is due to the extremely high tangential compressive stresses that are generated in the plate layers by the huge press brake machines in an endeavor to obtain sufficient radial forces to form the plate against the die inner wall which is circular.

Also, processes are known wherein metal sheet or plate is converted to a circular product utilizing a mandrel against which the blank is forced by cooperating rollers or other members. Such a process is shown, for example, in the prior U.S. Pat. No. 1,968,455, L. Jones, issued July 31, 1934. The use of a mandrel is inefficient because of the phenomena of "spring back" of the metal. In reality, the Jones' machine would be operative only with very malleable metals, and not with high strength metals necessary for modern day pipeline construction.

DISCLOSURE OF THE INVENTION

The present invention involves a metal forming apparatus that provides a solution to the problems that have heretofore been symptomatic of the industry. The machine effectively and economically forms a steel plate blank into a tubular body in a single operation. The compact apparatus does this without using the plurality of presses and huge and expensive buildings that have been required with the most widely used UOE process.

Also, the machine performs its function of making line pipe in a single stroke without the use of an internal mandrel or any kind of dies. During the power stroke of the ram, pusher blades engage the metal blank at its trailing edge. This action translates the blank through the gap between the pyramid forming roll elements. Unlike all other pyramid rolling machines, which use power driven rolls that, therefore, must be large in diameter to withstand high combined torsional and bending stresses, the forming roll elements of the machine are not power driven, but rotate by the motion of the metal blank which is pushed by the ram's energy.

In the embodiment shown in this application, the driving means for the ram assembly comprises linear actuators, such as large recirculating ball screws. The pusher blade is supported on a continuous slide positioned in a track extending along the bed of the machine. The head of the jack screw of the ram engages a precompressed resilient block to ensure compensation for slight cambers along the trailing edge of the blank. The pusher blade has an engaging profile that mates with the corresponding trailing edge of the blank. Idler rollers are positioned along the path of movement of the blank between the upper bed plate and the superstructure to maintain the plate in a fixed horizontal plane during the entire forming operation.

Furthermore, the machine accomplishes the desired roundness of the pipe without the requirement for a separate, preliminary crimping of edges and/or internal expanding. The problem strains that result because of the excessive stresses applied to the blank during the O-ing operation of the UOE process are also avoided.

The present invention provides "air bending" of the metal that is not possible with a mandrel-type machine, as shown in the Jones U.S. Pat. No. '455. In air bending, the bending forces are applied to the metal by a pyramid of roll forming elements which contact the blank at only three points. The bending takes place in the area between the two extreme contact lines along the full length of the blank. The bending action stresses the metal beyond its yield point all within its plastic range according to the selected machine program. This forming control is not possible when a mandrel is being used, as in the prior art Jones machine.

Since "spring back" is always related to the form of a die, or mandrel, it is clear that in the Jones machine, the shape of the tube would be larger in diameter than the mandrel used. The controls of the machine of the present invention are such that no compensation for "spring back" is required since there are no dimensions related to either mandrels or dies.

Whereas the Jones machine would work well with dead soft blank materials, such as lead, the machine of the present invention would not. It requires material that has a resiliency or elasticity. The success of my method is dependent on elastic recovery since, of necessity, after a large portion of the circumference of the desired circular cross section has been formed, about 270° or more, the guide rollers engage the leading edge of the partially formed circular tube and elastically deflect its entire length inwardly, thus converting the circular cross section into a spiral section. This automatic action is performed to change the path of the workpiece being formed to prevent the leading edge from striking the upper forming roll element and its cantilever support structure. Once the entire width of the plate has completely traversed through the air bending pyramid gap, the ram action stops and reverses, the spiral forming deflecting roll elements automatically retract, and the hinged superstructure elevates opening and enlarging the forming pipe closure. The tube elastically snaps into its closed round shape which is its free state.

The machine is dynamically controlled in all of its important functions. The machine is easily programmed from one standard size pipe to another in an infinite number of sizes, say from a 36 inch pipe, half inch nominal thickness steel, to a 64 inch diameter pipe, one inch thick steel wall. Furthermore, the pyramid roll elements may be programmed to provide initial crimping of the leading edge and finally at the trailing edge without interrupting the continuous process in order to obviate any slight "flat" that might otherwise be formed. The forming roll elements are of minimum diameter so that only a very short section of the plate is subject to this phenomena that has plagued the pipe forming industry in the past. However, with the dynamic shifting of the forming roll elements, the tendency for a slight flatness is effectively obviated.

In addition to the programming for desired pipe diameters, the dynamic control of the lower roll element cluster also allows forming of any desired shape tubular article of symmetrical or asymmetrical cross section. The lower roll element cluster revolves on its cradle to vary the radius of curvature as programmed. Windmill propeller blades and sailboat masts of a lightweight metal, such as aluminum or titanium, are just two of the other products that can be made with my concepts. In addition, multiwalled tubes of hard-to-form metal, such as stainless steel, may be formed for the first time.

The forming roll elements are mounted in an advantageous way to accomplish the desirable end results. First, as mentioned, the upper and lower rolls are of a minimum diameter to provide a wide range of pipe diameters with negligible "flats". The upper roll is formed of a plurality of segments extending along the length of the machine, and each of the segments is mounted on a cantilever arm. Surprisingly, I have discovered that the blank surface between roll element segments is completely formed and is without any marking of the metal. The blank moves smoothly between the pyramid roll elements with minimum effort due to the frictionless bearings used in all the rolls.

The line pipe machine of the present invention further contemplates a highly effective frame structure for providing the strength necessary to bend the high-strength steel. The superstructure assembly is formed by main vertical frame plates interconnected by angle cross webs. The superstructure plate subassemblies, including two frame plates and attached cross webs, preferably integrally cast, are interchangeable and provided as modular building components to make up a machine of any desired length. Extra subassemblies can be added as needed to the machine to make pipe of any desired length, such as forty (40) or sixty (60) foot lengths. The bed of the machine is provided with similar strong bed plates that can be modularly put together. Tie plates extending the length of the bed and the superstructure provide integration of the modular units together as one machine.

All of the auxiliary functions to make the machine completely self-supporting and automatic are provided. The plates are supplied through an in-feed section at one end of the machine with the finished tube being ejected at the opposite end. The superstructure lifts away from the base to provide the in-feed space required. Several disappearing locating roller gauges properly position the leading edge of the blank in the roll element cluster of the pyramid roll assembly. For expelling the pipe once it is formed, several disappearing drives and idler rollers are provided on lower opposite sides of the pipe to lift the pipe above the upper roller and automatically drive the pipe out the end of the machine while a new plate is fed and positioned in the machine ready to be formed.

Still other objects and advantages of the present invention will become readily apparent to those skilled in the art from the following detailed description, wherein I have shown and described only the preferred embodiment of the invention, simply by way of illustration of the best mode contemplated by me of carrying out my invention. Accordingly, the drawings and description are to be regarded as illustrative in nature, and not as restrictive.

BRIEF DESCRIPTION OF DRAWINGS

A preferred embodiment for carrying out the invention is described in detail below with reference to the drawings, in which:

FIG. 17 is an enlarged detailed view of the infeed rollers for the metal blank in the raised or in-feed position;

FIG. 18 is a detailed cross-sectional view taken along line 18—18 of FIG. 11 showing the tube unloader driver and the disappearing roller gauge to locate the forward edge of the blank, and FIGS. 19—21 show alternative multi-walled tubular forms.

DETAILED DESCRIPTION OF THE PREFERRED EMBODIMENT

Pyramid Roll-Forming System

Figure 1:
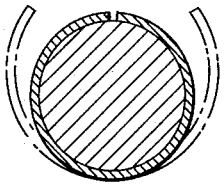
Fig. 1 PRIOR ART
FIGS. 1–3 show prior art use of mandrels for forming arcuate-shaped pieces and illustrating in dot-dash line the phenomena of metal spring-back.
Figure 2:
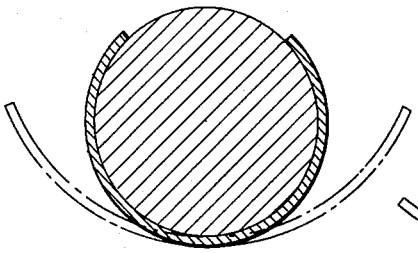
Fig. 2 PRIOR ART
Figure 3:
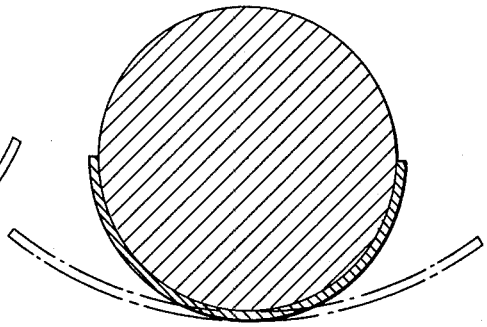
Fig. 3 PRIOR ART

FIGS. 1–3 show the prior art of forming a metal blank about an internal mandrel. In the three illustrations, the blank is of the same material and dimensions. Essentially, the internal mandrel diameter limits the amount that a metal blank can be bent inwardly to form a tubular body. The illustrations show the problem of spring back in forming a tubular body with mandrels or dies. The full line cross-section shows the bending of the metal blank to its innermost position; the dot-dash line position showing the deleterious spring back that is inevitable.

In the present inventive concept, the roll forming elements are merely set or programmed to provide the proper bending forces that form the desired radius of curvature.

Figure 4:
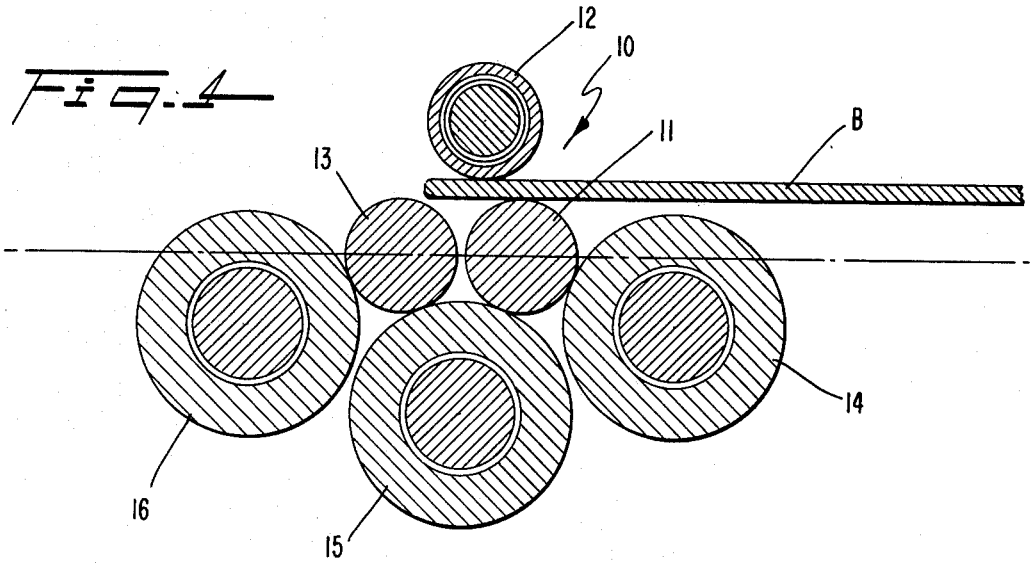
FIG. 4 is a cross-sectional view showing the pyramid roll element cluster utilized in the present invention with the metal blank in position ready for forming.
Figure 5:
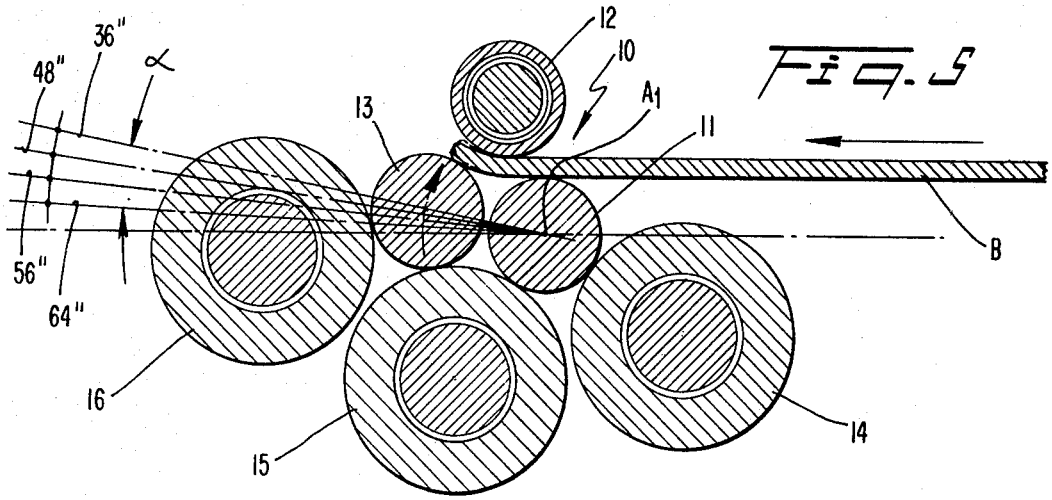
FIG. 5 illustrates the pyramid roll element cluster of FIG. 4 with the roll elements forming or crimping the leading edge of the blank.
Figures 6, 6A, 7A:
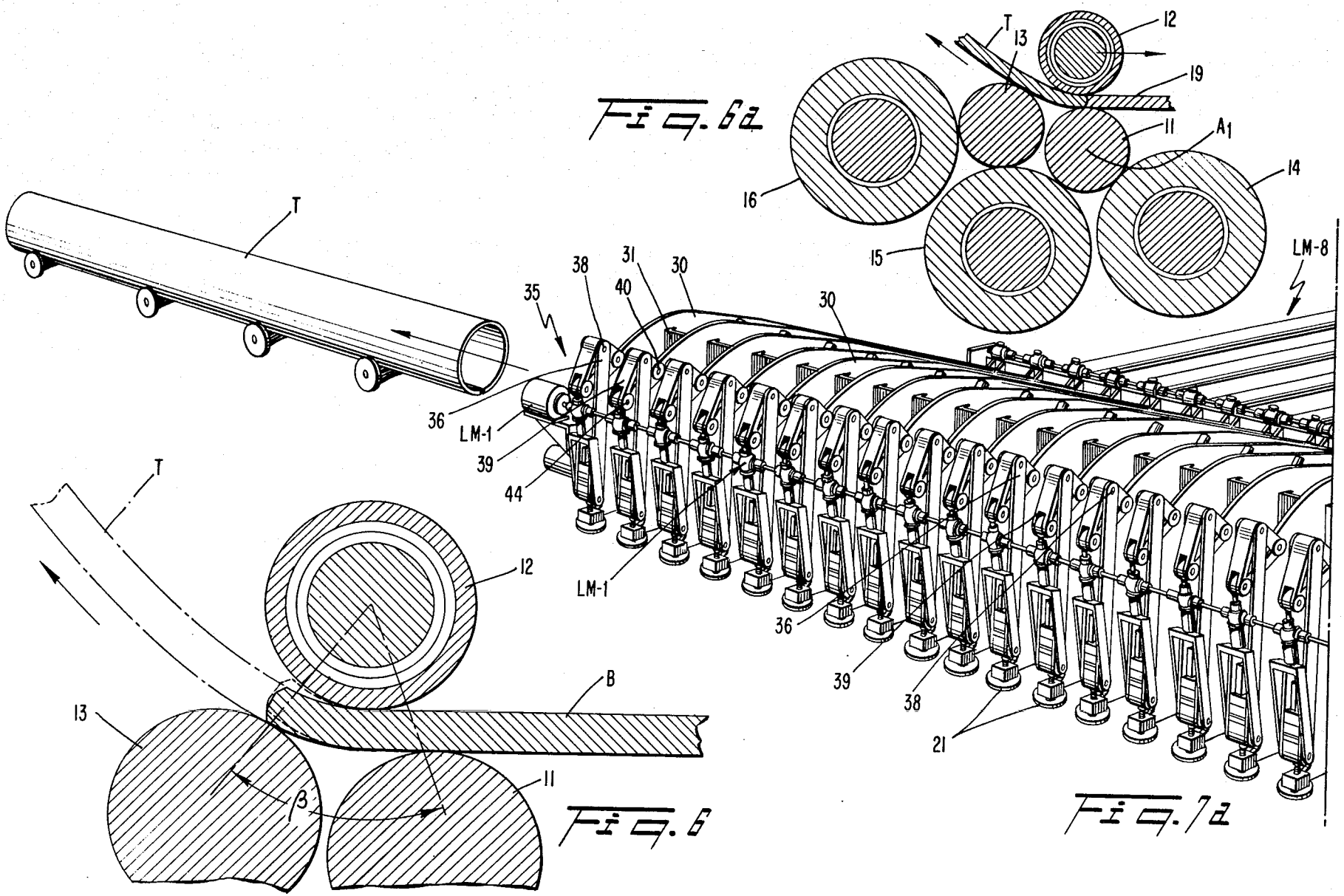
FIG. 6 shows the pyramid roll element cluster after the preforming step and during normal "air bending" of the tubular body (dash-dot outline)
FIG. 6*a* is a showing of the relationship of the rolls in the pyramid roll element cluster during the final crimp forming step of the trailing edge of the tube.
FIGS. 7*a* and 7*b* form a composite overall perspective view of the machine of the present invention showing the in-feed of a metal blank, the machine for forming the tube, and the tube after completion of the forming process and the expulsion of the tube from the machine.

The pyramid roll forming system of the present invention is thus shown in FIGS. 4, 5, 6 and 6*a*, with the various steps being illustrated in sequence. FIG. 4 is the position of the three-roll element cluster at the point where the blank is in position, but prior to being made ready for forming, and FIGS. 5–6*a* illustrate the subsequent sequential forming steps.

In accordance with the invention, a pyramid roll bending assembly 10 comprises a three-roll cluster made up of two lower or outer (outside the tube being formed) bending roll elements 11, 13 and one upper or inner (inside the tube) bending roll element 12. The roll elements 11–13 contrary to the prior art which taught the use of large forming rolls, are made to be of a minimum diameter not to exceed approximately five times the thickness of said blank. The roll diameter is a minimum commensurate with the range of sheet or plate metal thicknesses to be formed.

Figure 14:
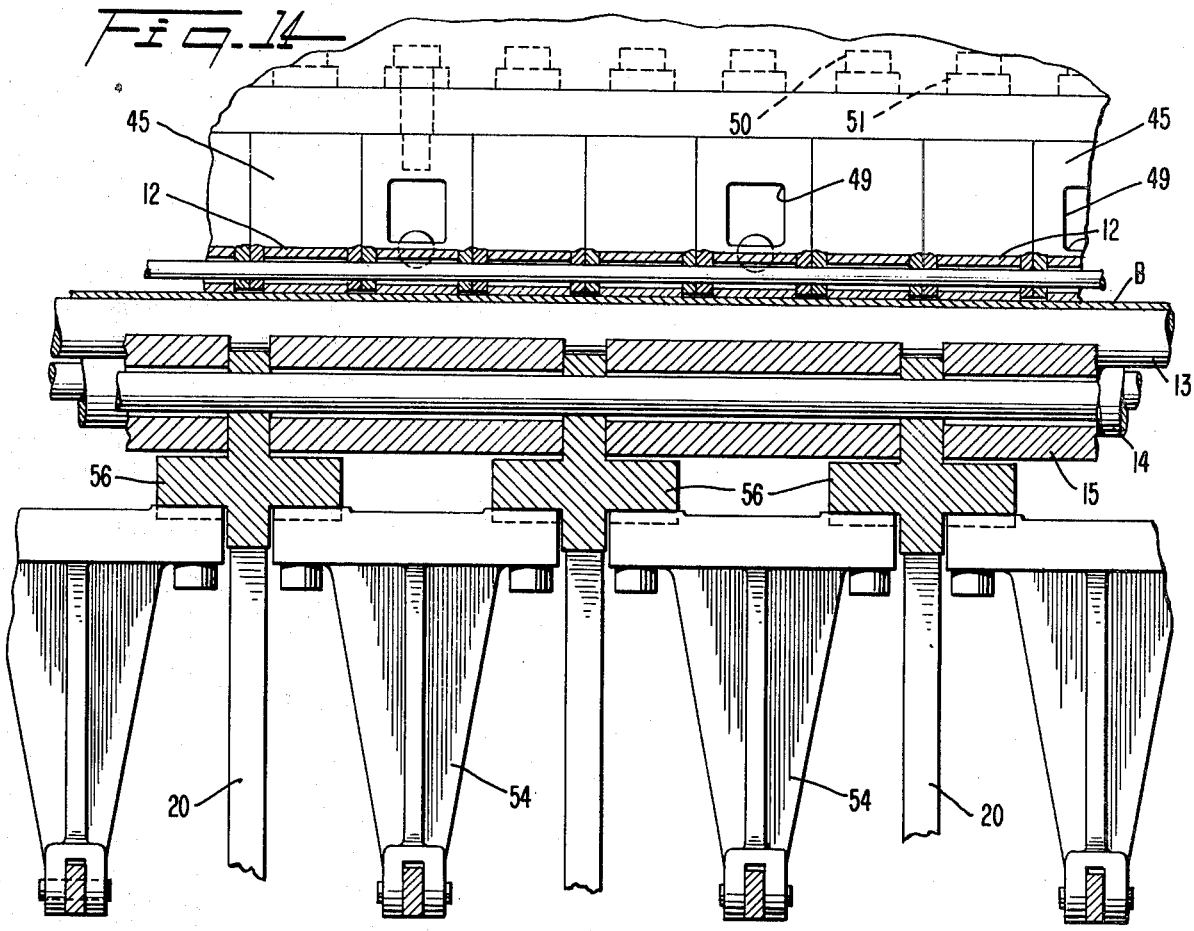
FIG. 14 is a cross-sectional view taken generally along line 14—14 of FIG. 12 illustrating the mounting of the roll-forming elements and lower back-up rolls.

The lower rolls 11, 13 are advantageously supported by cradle rollers 14, 15 and 16. As best shown in FIG. 14, the lower rolls 11, 13 are continuous steel bars whereas the cradle rollers 14–16 are a plurality of roller segments supported by an inner axle. In effect, the forming roll elements 11, 13 are resting within the support of the cradle rollers 14–16. Likewise, the upper forming roll element 12 is segmented and supported by individual arms or blocks, to be described later in detail.

As best shown in FIG. 14, the pyramid roll bending assembly is formed in modular units between major frame supporting elements of the overall machine. Throughout this application, it is to be understood that reference to particular components in a module unit are intended to refer to parts in all of the module units. One important aspect of the invention is, in fact, the use of the modular concept that allows this machine to be built in any desired length capacity to form pipe of various lengths.

In the machine of the present invention, none of the bending roll elements 11–13 or the cradle rollers 14–16 are power driven. The blank is propelled through the roll elements for forming by pushing the trailing edge of the blank by a ram pusher mechanism, generally designated by the reference numeral 18 (see FIG. 9). In this way, precise control of the movement of the blank through the roll assembly 10 and into a finished tube is assured.

Since there are no driven forming rolls, it is possible to use the smaller diameter forming rolls in my machine with the inherent advantage of allowing greater bending (tigher radius) with negligible tendency to form flats at the seam area. Furthermore, with my system and with the small diameter upper and lower bending roll elements 11–13, the tube can be formed or bent in a substantially curved arc all in one operation. Also of importance is that in the final stages of formation, approximately through the last 90° of the forming operation, the tube can be elastically deflected above the upper roll element 12 into a spiral configuration to allow the trailing section of the tube to be formed in the same continuous, single operation.

In accordance with the invention, the temporary compressive spiral deflection of the tube is provided within the limit of elastic recovery so that once the complete tube has been formed, the deflected portion snaps into its proper position ready to be welded. A double-layered tube may be formed by allowing continued spiraling past the 360° point, as will be seen in more detail later. The conventional welding step completes the pipe or other tubular article being formed. As mentioned above, in accordance with the features of the present invention that I have discovered, not only can pipe be formed utilizing the broadest aspects of the invention, but also a wide variety of other tubular forms, such as hot water tank casings, tapered poles, sailboat masts and other similar tubular articles.

In order to avoid the tendency to a "flat" at the leading edge of the blank B, in accordance with my invention, the dynamically movable roll forming elements may be so used in an initial stage to crimp the leading edge. With the leading edge in the position of FIG. 4, the dynamic adjustment of the upper roll element 12, as well as the whole lower cluster of roll elements and rollers, 11, 13 and 14–16, respectively, is effected, in accordance with the position shown in FIG. 5. This is just prior to any commencement of the forward motion of the blank B so that, in effect, a static crimping process of the leading edge is performed against the small upper roll forming element.

Next, the upper roll element 12 is shifted forward, while the lower cluster is revolved back about the axis of the lower bending roll element 11 within the angle to the position of FIG. 6 where the selected radius forming begins to occur immediately. In this instance, the blank B is being rammed through the air bend forming contact lines of the roll elements 11–13 designated by the angle $\beta$. It is within the angle $\beta$ that the correct bending occurs (small radius bending), so that the tube T is now being formed, as shown by the continuing dot-dash outline in its free state (FIG. 6).

When the tube T has been substantially fully formed, the pusher blade 19 stops. At this point the trailing edge has reached the end of its travel (see FIG. 6*a*). In this position, the dynamic adjustment of the upper roll element 12 is back toward the rear of the machine and the front lower roll element 13 revolves up to form the trailing edge by another static crimping operation. Next, the toggle links that actuate superstructure 30 release and the finished tube T snaps from between the roll elements into its free form, that of a circular section.

Figures 7B, 12C:
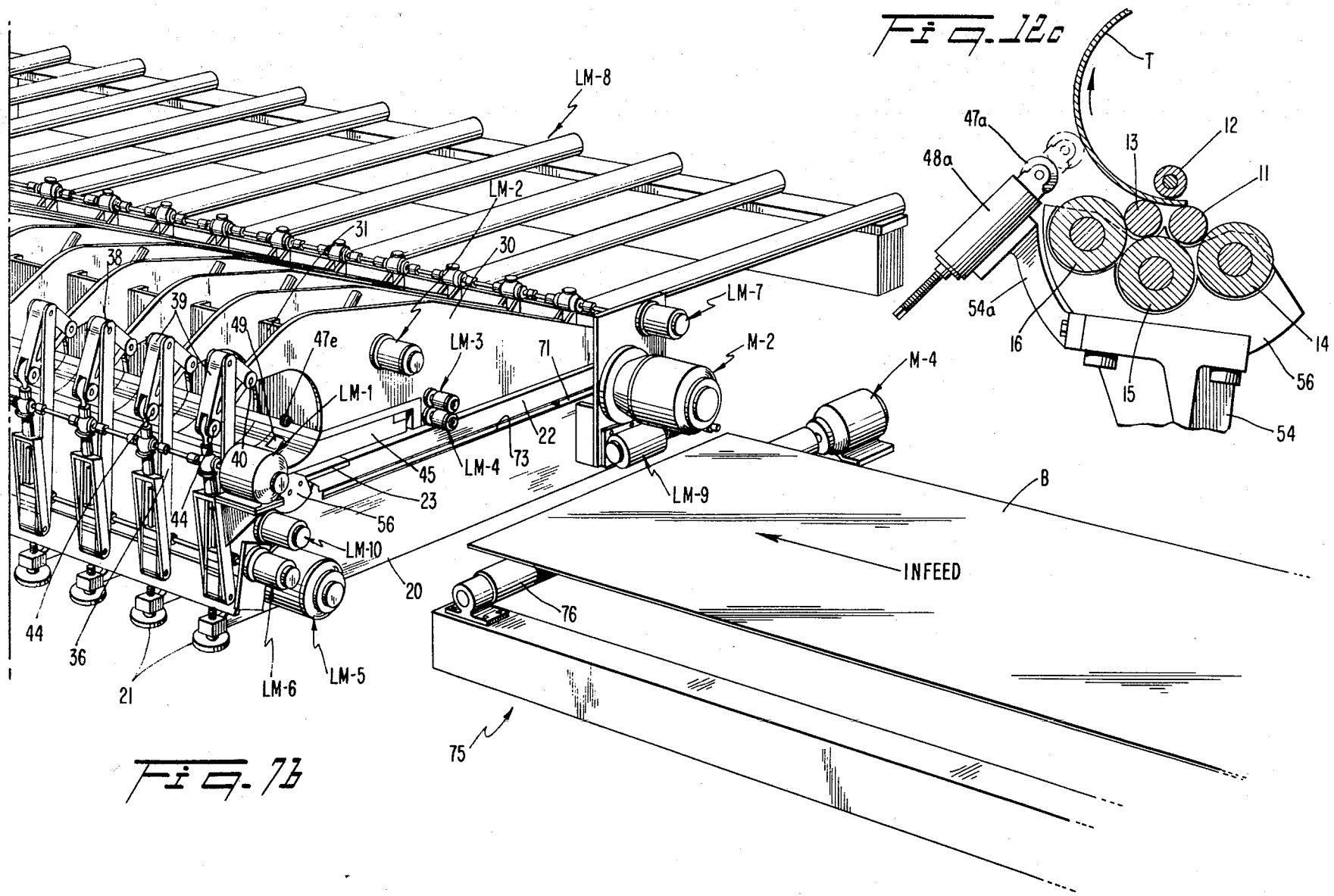
FIG. 12*c* is a detailed cross-sectional view showing an auxiliary form of the mounting of the first guide roller.
Figures 9, 12A, 12B:
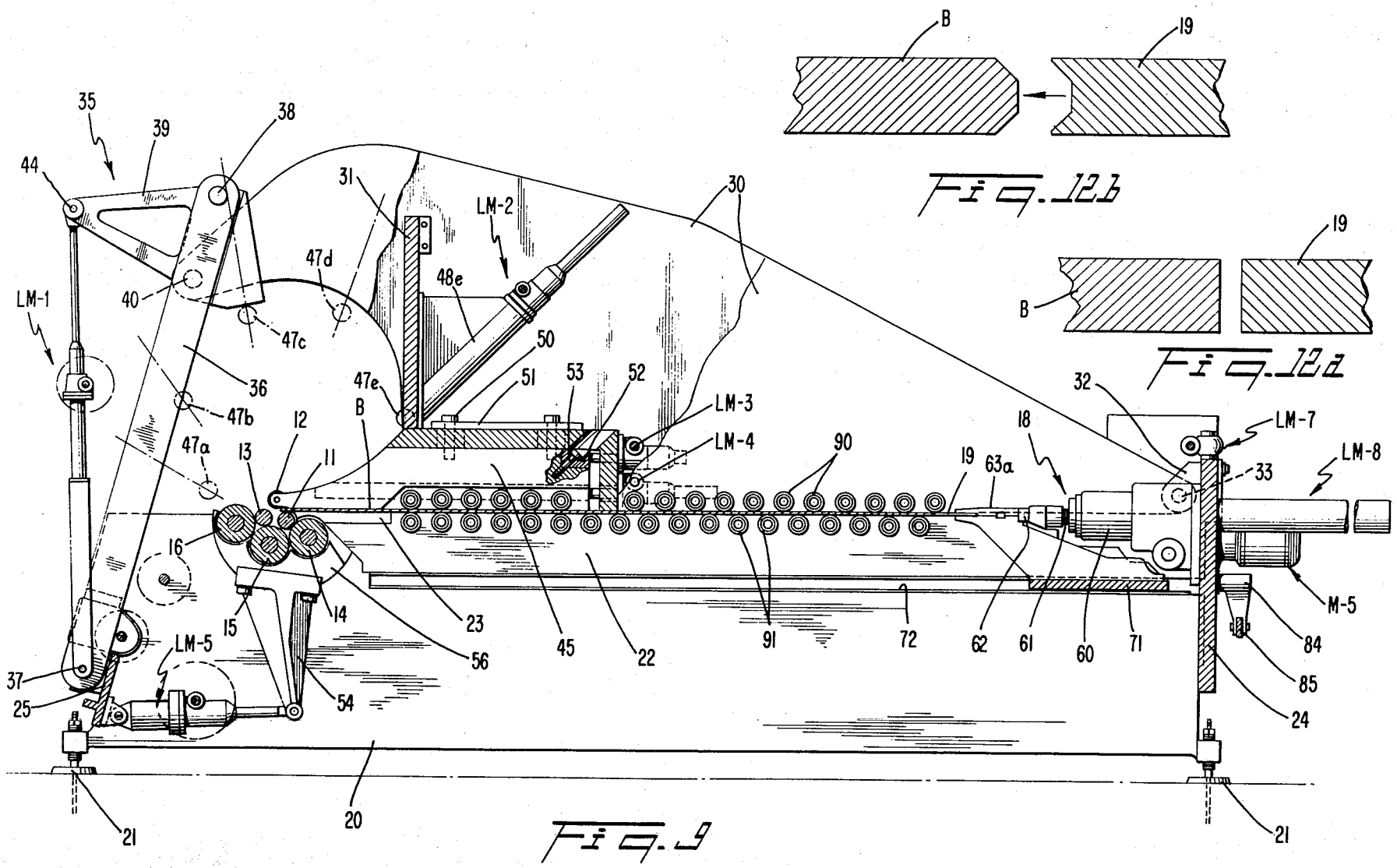
FIG. 9 is a cross-sectional view of the machine looking along line 9—9 of FIG. 8 and showing the bed and superstructure.
FIGS. 12*a* and 12*b* are detailed cross-sectional views showing the mating relationship between the leading edge of the pusher blade and the mating trailing edge of the metal blank; the metal blank of FIG. 12*b* being chamfered to provide for preferred weld penetration along the inner and outer periphery of the welded seam of the finished pipe.
Figure 11:
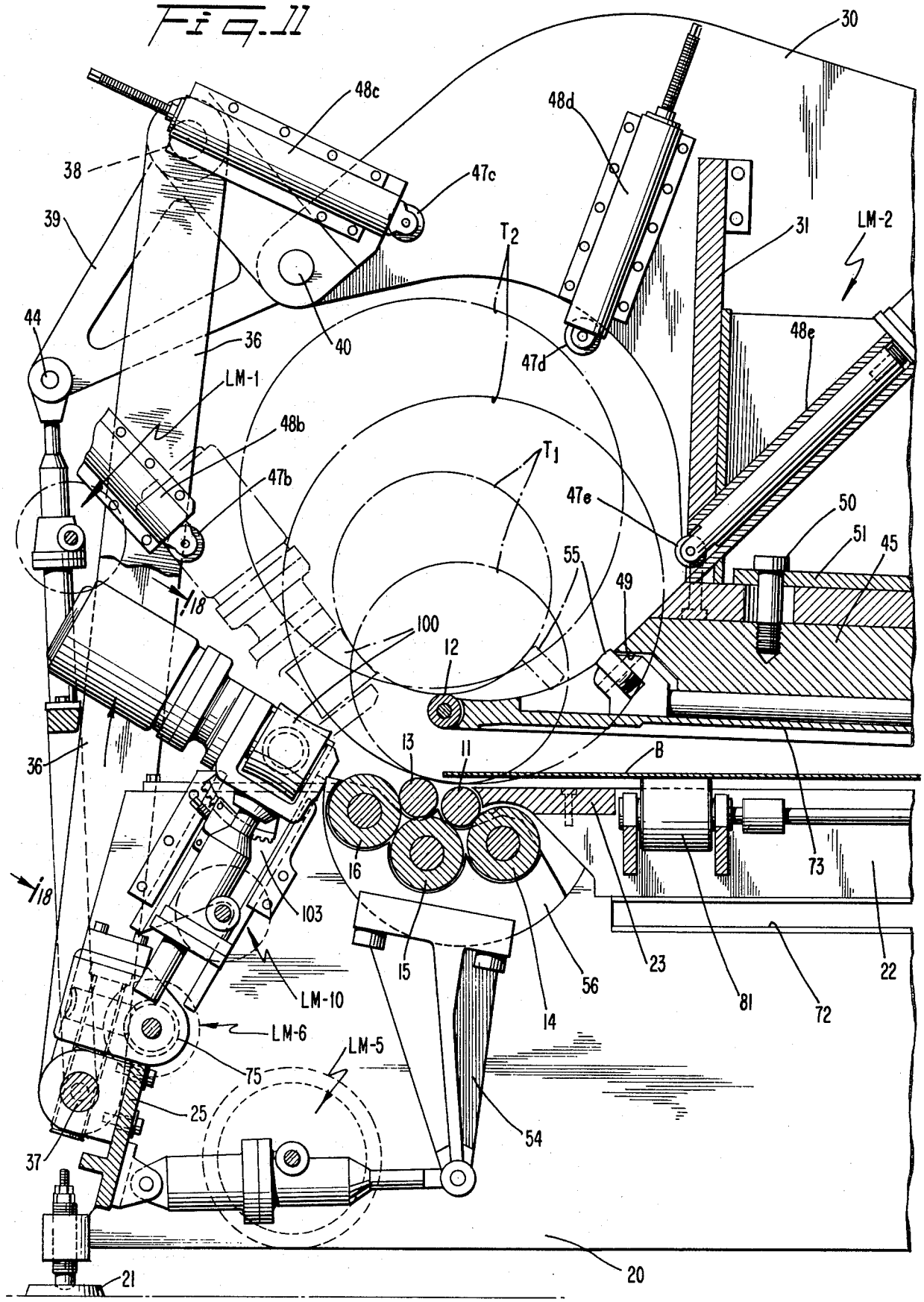
FIG. 11 is still another enlarged view of the front of the machine showing the pyramid roll bending assembly in the release position with small and large diameter tubes being shown by dot-dashed outline.
Figure 12:
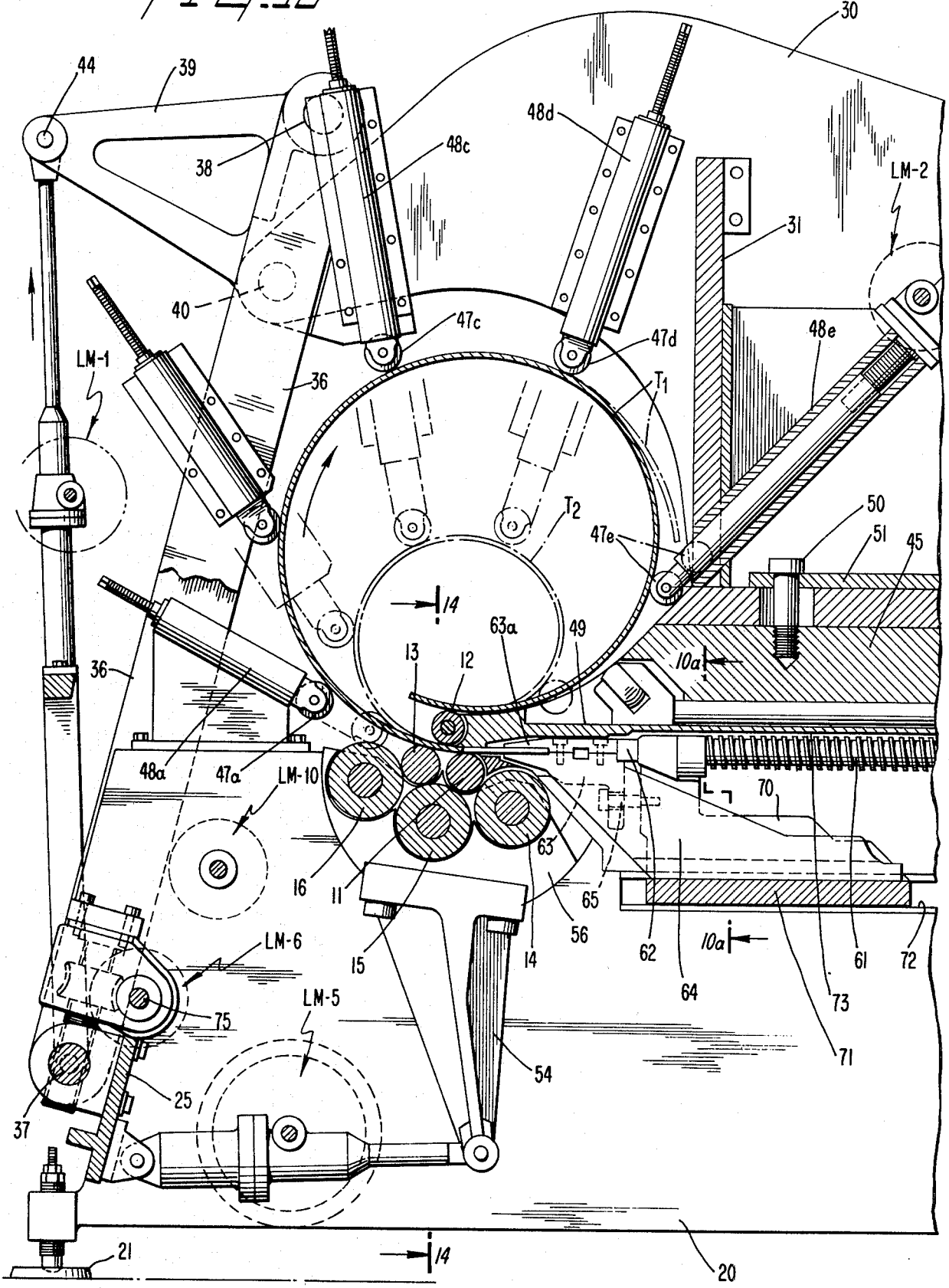
FIG. 12 is another detailed cross-section like that of FIG. 11 showing the actual formation of a tubular body of the largest size, and in phantom lines the formation of a smaller tubular body.

The revolving dynamic movement of the roll element 13 by movement of the cradle 56 is also effective to allow the formation of the various diameter pipes, as suggested by the two sizes shown in FIGS. 11 and 12. This is controlled by the angle of the cluster of roll elements and cradle rollers about the axis of the roll element 11. For example, in the preferred embodiment of the machine for manufacturing line pipe to transport petroleum products, the smallest diameter pipe could be selected as a 36 inch diameter pipe $T_1$; whereas, the largest diameter pipe could be a 64 inch diameter standard size line pipe $T_2$ (FIG. 12). The minimum and maximum angle notations of the cluster are shown in FIG. 5; it being understood that intermediate standard sizes of 48 inch and 56 inch diameter pipe could be formed by the simple dynamic adjustment between these two positions. Obviously, since the adjustment is continuously variable, an infinite number of sizes between the minimum and maximum diameters could be formed on my machine. This ability to form different size diameter line pipe is of significant importance since a line pipe installation using my machine can make any size pipe without the necessity for multiple presses and/or multiple sets of dies for the presses. This greatly relieves the capital outlay needed to provide a pipe mill for manufacturing line pipe, which is in great demand today.

Machine Frame Structure

As previously mentioned, the machine of the invention is preferably fabricated in modular units and the units have interchangeable parts to provide for maximum economy of machine manufacture. The bed of the machine is formed by a plurality of elongated, vertically positioned lower bed plates 20 (see FIGS. 7*b*, 9 and 16, in particular). The bed plates are supported by suitable adjustment feed 21 at the front (left-hand side of FIG. 9) and at the rear (right-hand side of FIG. 9) of the machine.

Positioned above each of the lower bed plates 20 are upper plates 22 (FIGS. 9 and 11). At the front of the upper bed plate is provided a horizontal, continuous guide plate 23 (FIGS. 9 to 11) that serves to tie together all of the upper bed plates 22 at the forwardmost position adjacent the roll element 11. At the rear of the machine, I advantageously provide a continuous rear tie support plate 24 extending along the length of the machine (FIGS. 9, 10 and 16) and supporting the bed plates 20 in keyways. At the forwardmost position of the lower bed plates, I provide a continuous toe plate 25 to tie together the forwardmost portion of the bed (FIGS. 9 and 11).

The superstructure assembly of the machine is also provided by a plurality of frame plates 30 with intermediate cross support webs 31 (FIGS. 7*a*, 7*b* and 9). The cross support webs are formed as an angle member with one leg extending vertically and the other leg extending horizontally, as best shown in the cross-sectional view of FIG. 9. Preferably, this angle web is integrally cast of high strength metal alloy with the frame plate 30 interconnecting a plurality of these modules.

Figures 10, 10A:
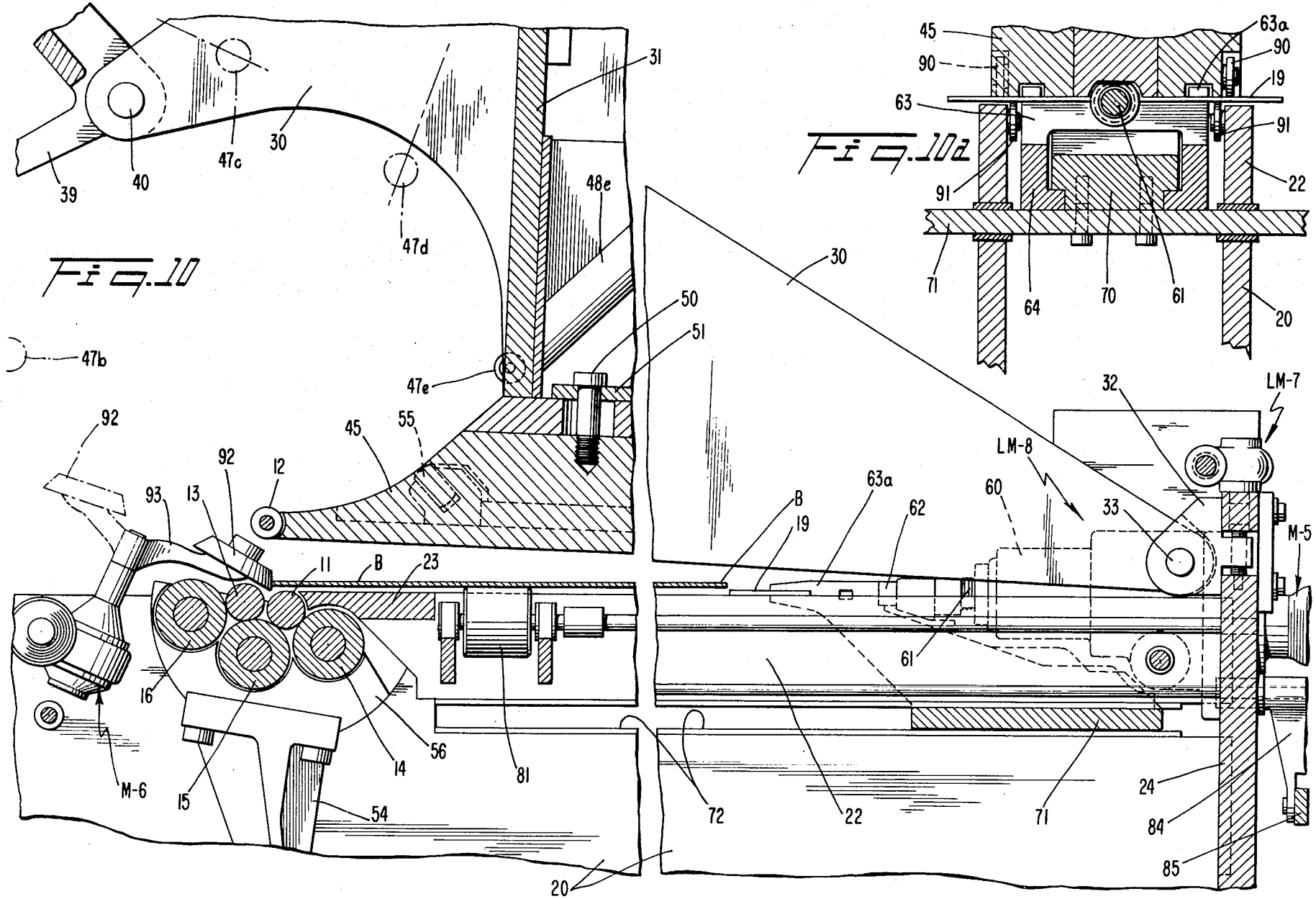
FIG. 10 is an enlarged partial cross-sectional view of the machine showing the metal blank in the in-feed position.
FIG. 10*a* is a cross-sectional view taken along line 10*a*–10*a* of FIG. 12 showing the ram assembly and its support along the track in the bed of the machine.

At the rear, the frame plates are attached to the rear tie support plate 24 by adjustable support yokes 32 and individual pivot pins 33 (FIG. 10). As shown, the entire superstructure assembly can be raised by pivoting about the pins 33 to allow infeed of the blank B into forming position.

The front of each superstructure frame plate 30 is attached by a toggle linkage system, generally designated by the reference numeral 35 (FIGS. 7*a* and 9). Dual connecting links 36 extend between a pivot 37 and an upper pivot 38 attached to a triangular shaped overcenter lever 39. The lever is, in turn, connected to the frame plate 30 by individual pivot pins 40.

Figure 15:
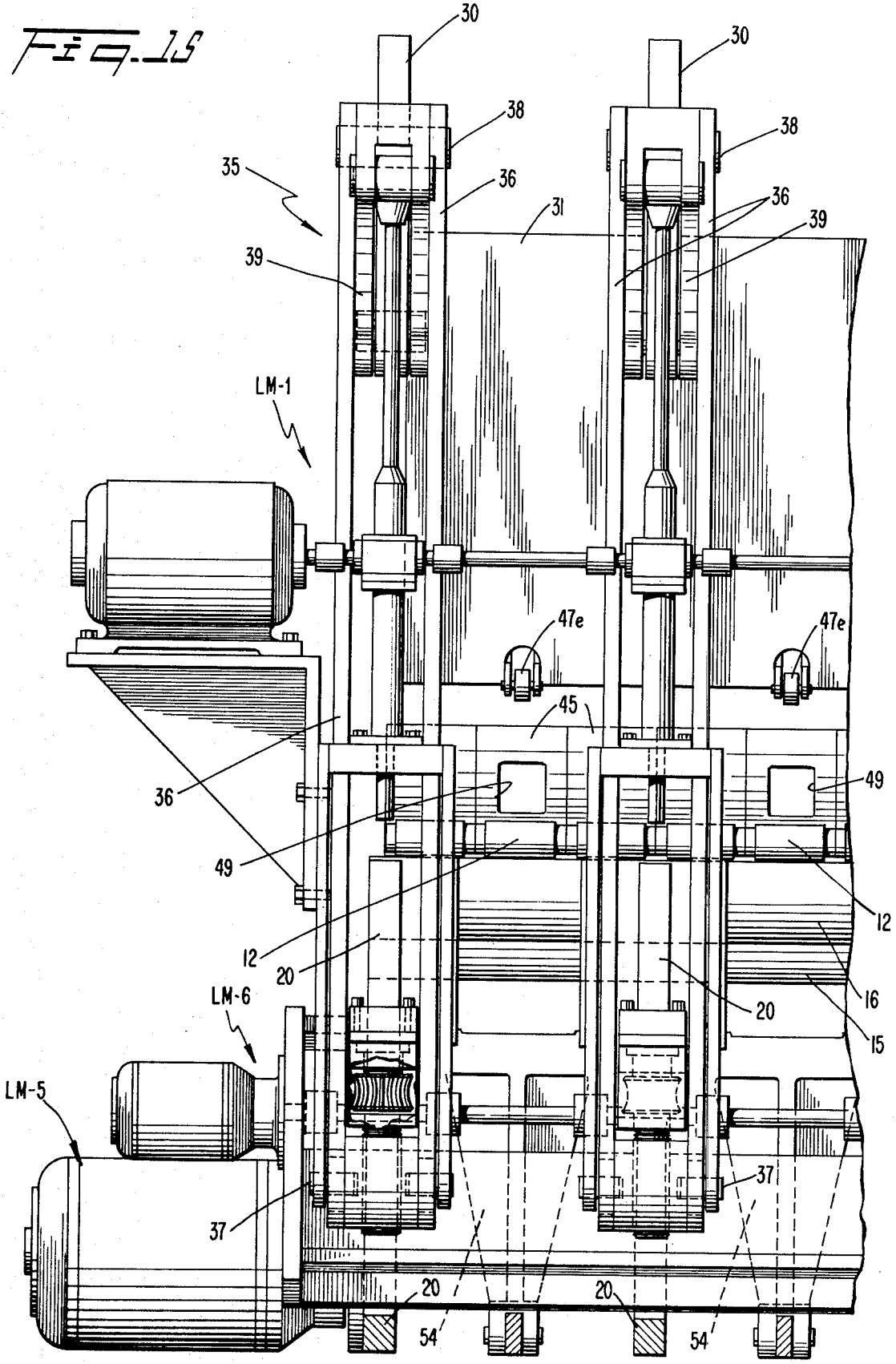
FIG. 15 is a front elevational view of the tube exit end of the machine showing the mechanism for closing the machine for operation and the adjustment of the position of the superstructure.

Linear motor assembly LM-1, including a drive shaft and individual transmissions (FIG. 15), moves the triangular lever 39 so as to close the linkage system 35 forming a toggle with the upper pivot 38 in the overcenter position, as shown in FIG. 9 when the machine is ready for operation. As shown in FIG. 11, the linear motor is effective to raise the superstructure when the triangular lever 39 is rotated about the upper pivot pin 38 to lift the pivot pin 40 for the infeed of the blank B.

Figure 8:
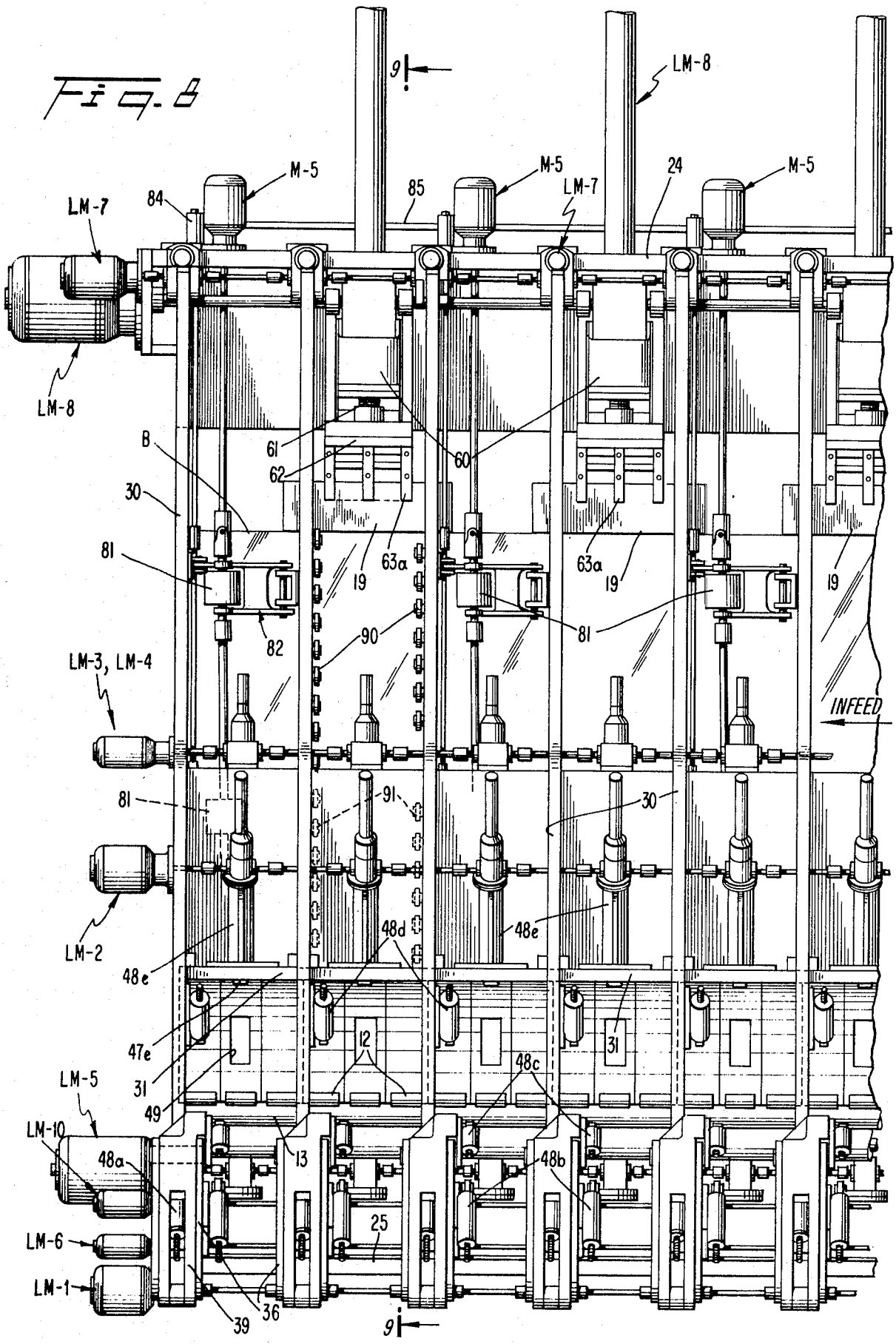
FIG. 8 is a top plan view of the left-hand end of the machine shown in FIG. 7*a;*

For mounting the upper roll element 12, there is provided a plurality of cantilever arms or blocks 45. For each modular unit, I presently contemplate three segments for the roll element 12, and consequently three detachable and interchangeable roll support blocks 45 for each modular unit (FIGS. 8 and 14). These cantilever blocks are a very key part of the apparatus of the present invention. They are manufactured of very high strength steel and serve to support the upper roll element 12 to form the metal.

It can be seen that the entire main frame structure of my machine is extremely strong and rigid. This gives excellent forming characteristics to the machine. The blank B can be formed into a finished tube T all in one operation. Giant presses are not required so that the capital investment for forming line pipe is greatly reduced utilizing this machine.

During the forming of the tube or pipe T, idler guide rollers 47*a*, 47*b*, 47*c*, 47*d* and 47*e* serve to confine the outward expansion, as best shown in FIG. 12. During formation of the first tube in the production set up, the idler rollers 47*a*–47*d* are preadjusted in their adjustable bases 48*a*–48*d*, respectively. These adjustments are easily made by a jack screw and locking arrangement, shown in FIG. 12. For any particular size tube T being formed, the adjustment is simply made by (1) forming the tube through approximately 270° (see dotted line leading edge in FIG. 12), and then (2) bringing the guide rollers 47*a*–47*d* into touching contact as shown. At the 270° position, the guide roller 47*e* is automatically brought into the full line working engagement shown in FIG. 12 by the linear motor assembly LM-2. In the final 90° formation of the tube T, the tube is spirally elastically deflected and compressed (see FIG. 12) by the roller 47*e* to slide past and be guided by the upper curved surface of the cantilever arms or blocks 45.

Dynamic Control of Machine Functions

The final guide roller 47*e* is dynamically controlled within its guide housing 48*e* by the linear motor assembly LM-2. For the largest pipe size for this particular machine, the roller 47*e* is moved to the full line position of FIG. 12 once the 270° position (dotted line position) has been reached. The movement of the roller 47*e* is timed so that there is no loss of motion in the continuous pipe-forming process. For the smaller diameter pipe, also as shown in FIG. 12, the roller 47*e* is positioned well down into the concave surface of the cantilevered support arm 45 so as to properly guide the tube $T_2$. The center cantilever block 45 of each module has a recess 49 into which the roller 47*e* may be positioned for the smaller pipe operation (see also FIG. 14).

The cantilevered support blocks 45 are advantageously carried underneath the horizontal leg of the angle cross web 31 by means of retainer screws 50 and retaining plates 51 (FIGS. 9 and 10). A rear tie bar 52 for the blocks 45 extends the full length of the machine and is interconnected to each of the cantilever blocks 45 by a cap screw 53 (FIG. 9).

Figure 13:
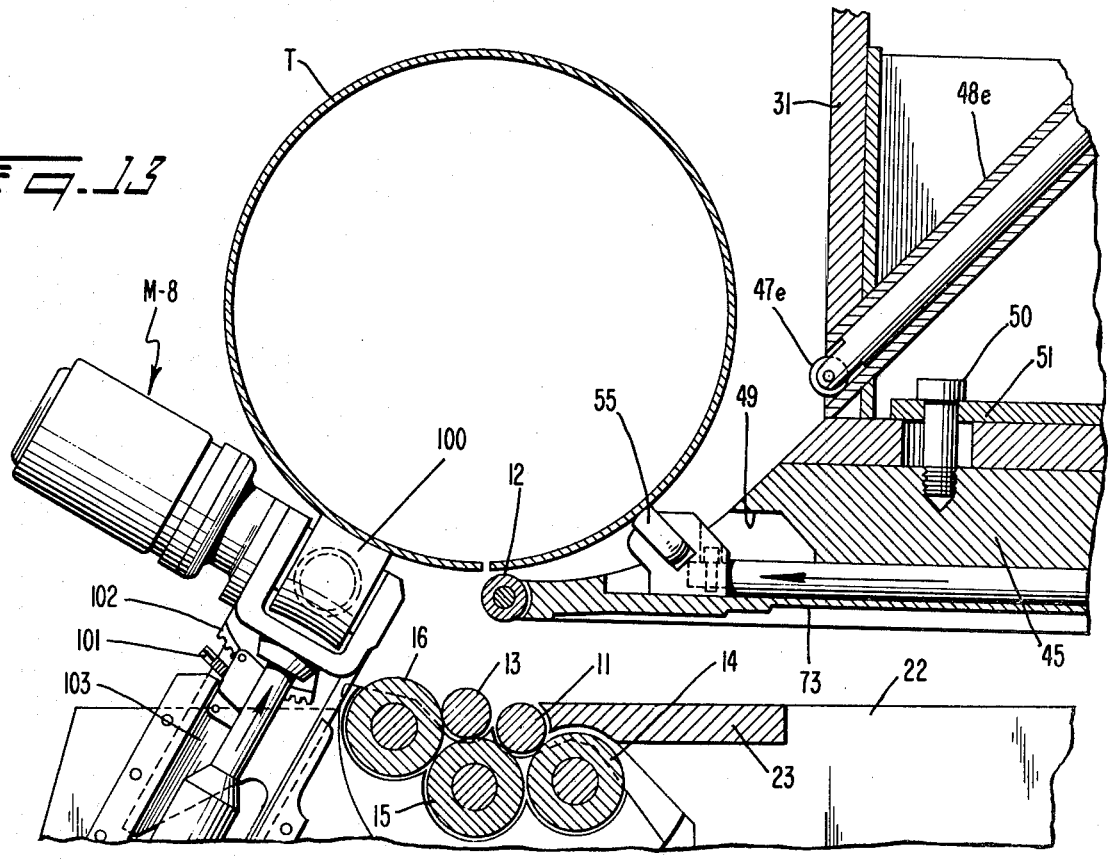
FIG. 13 is an enlarged cross-sectional view with parts removed from the view for clarity showing the finished tubular pipe positioned on the extended, retractable expelling rollers; one driving roller and one idler roller mounted on every other modular unit of the machine (see FIG. 18)

Mounted on the downward extension of the lower leg of cross webs 31 is a linear motor assembly LM-3. This provides for the dynamic control of the upper roll 12. The retainer screws 50 mounting the blocks 45 are allowed to travel within the elongated slots of the angle cross web thereby accommodating the dynamic movement of the upper roll element 12. A linear motor assembly LM-4 serves to slide an idler support roller 55 within the recess 49. This idler support roller carries one side of the finished tube T in any one of the selected positions, such as shown in FIG. 13, and as will be explained further in detail below.

The cradle rollers 14–16 are carried by cradle 56 in order to provide another of the important dynamic positioning features of the machine. Each cradle 56 is supported for oscillation action about axis $A_1$ of the first in-line lower roll element 11 (see FIGS. 5 and 6*a*). This adjustment generates orbital movement of roll element 12 about axis A, and provides the variable angle $\alpha$ to provide the adjustment through the range of pipe sizes; for example, 36 inch, 48 inch, 56 inch and 64 inch line pipe (FIG. 5). The action of the cradle 56 is gained through an operating arm 54 connected to the linear motor assembly LM-5 (FIG. 9). The base of the linear motor LM-5 is mounted by a suitable yoke on the toe plate 25.

Thus, to set up the machine for a particular diameter tube T to be formed, the cradle 56 is adjusted so as to vary the angle $\alpha$ through operation of the motor assembly LM-5. Simultaneously, the upper roll element 12 is shifted back and forth responsive to motor assembly LM-3 to the proper location. It can be seen that the positions depicted in FIGS. 4, 5, 6 and 6*a* are easily accommodated by movement of these two dynamic-controlled members. The controls for motors LM-3 and LM-5 can, in addition to being responsive for change in line pipe size, monitor and modify the position of the roll elements as a result of other variables, such as deflections of the cantilever blocks 45 under operating loads. Such deflections are normal in any heavy machine operation. In this case, compensation for any deflection is readily implemented.

As the diameter of the tube T increases, the thickness of the blank generally also increases. The links 36 are therefore adjustable to raise or lower the plates 30 at the front by means of a linear motor assembly LM-6 (FIG. 12). The rear of the machine is adjustable by raising or lowering the yoke 32 for the main pivot pin 33 by means of the linear motor assembly LM-7. Thus, it can easily be seen that my machine is capable, through dynamic movement of the upper roll element 12 and the lower roll elements 11, 13, and the upper frame plates 30, at both the front and the back, of providing a tube T of the desired diameter and wall thickness.

In FIG. 12*c*, the first guide roller 47*a* and base 48*a* is mounted on an auxiliary bracket 54*a* attached to the arm 54 supported by the cradle 56. This arrangement simplifies the dynamic adjustment during the trailing edge crimping operation. Especially in the larger pipe sizes, the first roller advantageously revolves with the cradle 56 to assure that there is no deformation of the tube T as the crimp is formed.

Pusher Mechanism

One of the important distinctions over the conventional three-roll systems, either the pinch-type or the pyramid-type roll concepts, is the elimination of the driving function on the rolls. None of the forming roll elements 11–13 of the present system is power driven so that the problems of slippage and the need for larger diameter rolls, is eliminated.

Figure 16:
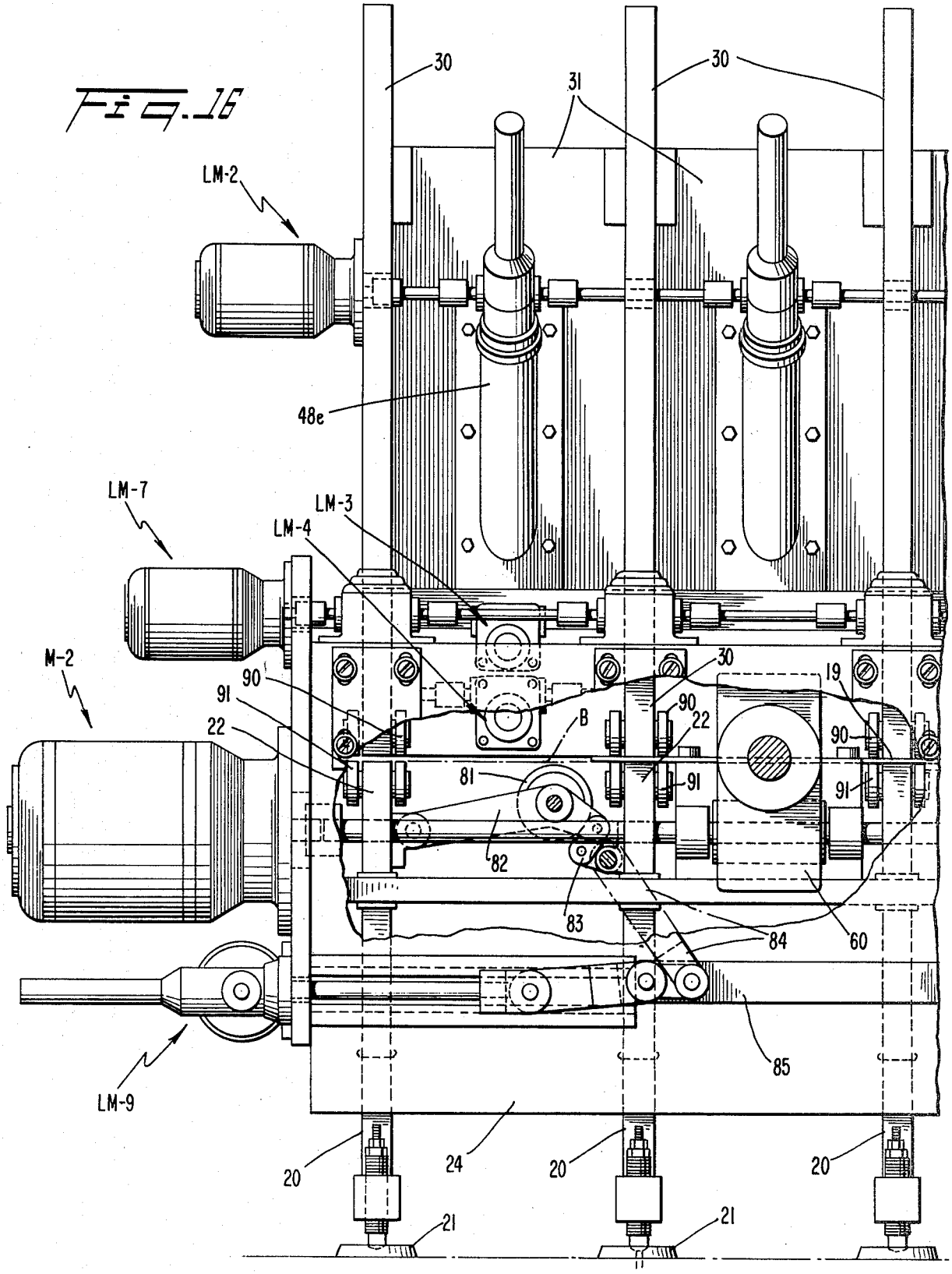
FIG. 16 is a partial cutaway view showing the back of the blank feeding end of the machine of FIG. 7*b;*

Instead of power-driven rolls, I provide a highly efficient pusher or ram mechanism, generally designated by the reference numeral 18. Linear motor assembly LM-8 (FIGS. 7*b*, 8 and 16) includes two main rotary motors at both ends of the machine and a common drive shaft (FIGS. 10 and 16). The linear motor assembly LM-8 includes a plurality of transmissions 60 and jack screws 61 (FIGS. 10, 12 and 16) that may be of the ballbearing type driven screw 61, as shown. The head of the screw 61 operates through a resilient block 62 against the pusher slide head 63. The pusher slide head 63 in turn holds the pusher blade 19 that abuts against the rear edge of the blank B (see FIGS. 12*a* and 12*b*). The edges of the blank B are usually chamfered in order to better produce 100% weld penetration (see FIG. 12*b*). In this embodiment, the pusher blade 19 has a leading edge that corresponds to this chamfered edge of the blank B.

The pusher slide head 63 is attached to a slide saddle 64 for every other modular unit. Mounting screw 65 is designed to precompress the resilient block 62 between the head 63 and the saddle 64. As will be clear from FIG. 12, the head 63 is thus resiliently held so as to absorb any slight variations in the rear edge of the blank as the pusher blades 19 engage it along the length of the machine (see FIG. 8).

Each pusher slide saddle 64 is held by a saddle retainer 70 (FIG. 10*a*) in turn mounted on a slide plate 71 that, in effect, ties together all of the pusher blades 19 and their unit assemblies. The slide joint between the saddle 64 and the retainer 70 and the precompressed resilient block 62, allows the blank B to move forward with a substantially even force along the entire length to provide for exceptionally good forming of the tube T. The slidable plate 71 moves along track 72 delineated by wear plates, as best shown in FIGS. 10 and 11.

In the middle cantilevered support block 45, a recess 73 (see FIG. 11) is provided in which top clamping fingers 63*a* of the pusher head 63 nest in the full forward pushing position (see FIG. 12). Also, of course, the plates 23 are recessed as necessary to accommodate the forwardmost position of the head 63. Note in FIG. 8, that alternate modular units do not have a pusher assembly so that the blocks 45 in these locations are not affected. The pusher heads 63, in effect, bridge three modular units, and provide in concert a powerful driving force that is constant and safe in design.

Sheet Blank In-Feed and Support Mechanism

With the front of the machine open as shown in FIG. 10, the sheet blank B is ready to be loaded from an independent conveyor structure, generally designated by the reference numeral 75. This structure has a plurality of driven rollers 76 (and idler rollers not shown) with rotary motor M-4 to thus move the blanks B into the adjacent end of the machine.

As the rollers 76 drive the blank B into the machine, the blank rests on a plurality of retractable infeed drive rollers 81. As shown in FIGS. 8 and 10, these rollers 81 are driven through a drive shaft and a rotary motor M-5. The drive rollers 81 are raised or lowered (FIGS. 16 and 17) with a toggle linkage 83 attached to one end of support link 82. A swinging arm 84 in turn operates the toggle linkage 83 as it oscillates responsive to a drive and connecting link 85. The connecting link 85 extends across the rear of the machine and is operated by the linear motor LM-9 (see FIG. 16). In the lowered position (FIG. 16), the drive rollers 81 are below the level of the blank B and the blank is ready for the bending operation.

Upper and lower pairs of idler rollers 90, 91, respectively, on the frame plates 30 and the upper bed plates 22 (FIGS. 9 and 16) support the blank and prevent buckling of the blank under compression of the pusher blade as the forming operation takes place. As previously described, the frame structure, including the toggle linkage system 35 at the front of the machine and the rear support yoke 32, and the various frame plates and tie plates form an integral frame structure of extremely high strength and integrity. This advantage and the guide rollers 90, 91 mounted at close intervals (FIG. 10), makes for a highly efficient forming operation.

As the blank B is fed into the machine, it is desirable that the forward edge be aligned exactly with respect to the upper and lower roll elements 11-13 (see FIG. 10). This is accomplished by a disappearing in-feed idler gauge roller 92 for alternate ones of the modules. The gauge roller 92 is supported on an arm 93 that is preferably operated by a rotary solenoid or motor M-6. When released, the roller 92 disappears to the dotted line position of FIG. 10. Once the motor M-6 is activated, the arm 93 is rotated to the operative position and in this instance guides the front edge of the plate as it comes in. The drive rollers 81 are positioned at a slight skewing angle so as to constantly urge the blank B toward the front of the machine against the forward gauge roller 92. Rotary motor M-5 drives all of the drive rollers 81 along a single module through a drive shaft and universal joints (see FIG. 8).

Tube Unloader Mechanism

In alternate modules to the gauge roller 92, I provide tube unloader rollers that are operatively driven to quickly discharge the tube T after the forming operation is completed. One side of the finished tube T is supported by the idler roller 55 (FIG. 12), projected into the forming area by the linear motor assembly LM-4. The opposite side of the tube T is supported by a driven expelling roller 100 powered by rotary motor M-8. In the withdrawn position shown in FIG. 11, the roller 100 is below the position of the largest tube $T_2$ during the forming operation. When engaged, the expelling roller 100 and the idler roller 55 support the tube T above the periphery of the upper roll element 12, as shown in FIG. 13.

The position for the roller 100 for each different size tube T, can be adjusted by means of jack screw 101 that operates the rack 102 thereby tipping the roller 100 with respect to its frame (see FIG. 13). A linear motor assembly LM-10 provides the raising and lowering of the roller 100. With the ejecting mechanism as just described, it can be seen that the full operation of the machine is thus automatic and highly efficient.

In certain pipe uses, it may be desirable to have more than a single thickness of metal. A partial double wall as shown in FIGS. 19 and 20, can be useful for selective reinforcement of the tube T′, T″, respectively. For example, where another piece is to be welded along one side of the pipe, the 20° double wall tube T′ (FIG. 19) is found to be a useful product. For greater strength on the reinforced side, such as where a matrix of sealed tubes are being used to support a floating platform, more reinforcement, such as tube T″ with 180° overlap, can be used.

The machine of my invention can advantageously be used to form a full double-walled tube T‴. The clear advantage is that a blank of only one half the thickness, but twice the width, may be more feasible in certain instances, expecially in the high strength and corrosive resistance steels, such as stainless steel. The forming machine parts are sized down from what would otherwise be required for a particular gauge blank. There is no interference with an internal mandrel during forming, as would be the case with prior art machines.

The dynamic action of the roll forming elements 11-13 permits any necessary adjustment (especially with larger gauge blanks) as the outside spiral wraps around the inner spiral, as shown in these figures. The deflection of the tube above the blocks 45 occurs starting with the 270° position, as through 360° and up to and beyond 720°, as required. Preferably, an inside and an outside weld along the edges completes the pipe with the same strength characteristics as a pipe made with a blank of double the gauge. The inner spiral is formed so as to retain the resiliency forcing it against the inside of the outer spiral. With lighter gauge blanks, double-layered tubes T'-T''' may be effectively formed without any such intermediate adjustment.

It can now be seen that the total concept of the line pipe forming apparatus and method of the present invention is to be able to fabricate a tube in one continuous forming operation with accuracy of forming that has heretofore not been attainable with the well-known UOE process. A low energy, controllable bending force, rather than brute force of presses is used in my machine to bring about the efficient operation. The metal blank is crimped at the two edges to avoid any tendency for flats. The pipe is deflected above the upper roll forming element 12 into a spiral, which may be through more than 360° for greater strength, and all as a continuous forming operation in the single machine. The forming roll elements are dynamically movable to adjust for the crimping operation as well as for adjusting the size of the tube. The spacing between the superstructure and the base is easily adjusted for different blank thicknesses. Automatic loading of the metal blank and unloading of the finished tube are provided.

The present invention is not limited to the specific details shown and described, and modifications may be made in the Line Pipe Forming Apparatus and Method without departing from the principles of the invention.

I claim:

1. Apparatus for forming a substantially closed elongated tubular article without the use of an internal mandrel or dies from a flat metal blank comprising inner and outer forming elements, means for mounting said elements relative to each other so as to provide a bend in said blank when the blank is passed therebetween, means to move said blank between said elements to progressively bend said blank along a substantially curved arc to form the tube, said mounting means including cantilever support means for mounting said inner forming element adjacent the end thereof, said inner forming element being positioned adjacent the point of forming of said bend, and means to compressively deflect said tubular article into a spiral within the limit of elastic recovery by guiding a leading edge of said article over said inner element, whereby upon release of said article by said deflection means full formation of a closed cross section in said tube is assured.

2. The apparatus of claim 1 wherein said means for mounting said forming elements include means for adjusting said inner and outer forming elements relative to said blank entering said forming apparatus to allow formation of the leading and trailing edges and different size tubular articles.

3. The apparatus of claim 2 wherein said forming elements include at least one inner and two outer in-line rolls positioned in pyramid relationship, said means to deflect including said cantilever support means, and said means for adjusting causing the second in-line outer roll and the inner roll to change the entry angle of said blank while maintaining the pyramid relationship whereby to provide the adjustment of the edges and the diameter of the tubular article being formed.

4. The apparatus of claim 1 wherein said forming elements are rolls having a diameter not to exceed approximately five times the thickness of said blank, whereby circular arcs are assured adjacent said leading and trailing edges and the elastic limit of the completed tube is not exceeded to form said closed cross section.

5. The apparatus of claim 1 wherein said means over said inner forming element to guide said tubular article during deflection includes said cantilever support means.

6. The apparatus of claim 5 wherein is provided means to retract said cantilever support means and inner forming element and said guide means and means to support said tubular article free for axial movement out of said forming apparatus.

7. The apparatus of claim 1 wherein said cantilever support means comprises a plurality of cantilever support arms parallel to and above the plane of said blank, said inner element comprising a plurality of roll segments each mounted on the end of one of said arms.

8. The apparatus of claim 7 wherein said forming apparatus includes a plurality of superstructure frame plates extending substantially perpendicular to the plane of said blank and supporting said inner element.

9. The apparatus of claim 8, wherein a plurality of said cantilever support arms are mounted and supported between adjacent superstructure frame plates.

10. The apparatus of claim 8, wherein is further provided means for pivotally mounting said superstructure frame plates for movement in concert to retract the support arms and roll segments away from the outer forming elements.

11. The apparatus of claim 10, wherein is further provided extendible roller means to support said tubular article free of said forming elements including said inner roll segments for axial movement out of said forming apparatus when the frame plates are retracted.

12. The apparatus of claim 8 wherein is provided corresponding bed frame plates supporting said outer elements, corresponding superstructure and bed plates being aligned in the same substantially vertical plane and said blank being positioned between adjacent edges of the frame plates, said moving means being provided by ram pusher means between the adjacent edges of the frame plates to engage the trailing edge of said blank.

13. The apparatus of claim 3, wherein is provided cradle rollers for said lower rolls, cradle means supporting said cradle rollers for floating action, and means to tilt said cradle about the axis of said first in-line roll to provide fixed orbital movement of the second in-line roll.

14. The apparatus of claim 2 wherein said means for adjusting said elements includes linear motor means for shifting the upper forming element parallel to said blank, and cradle means for shifting the second in-line lower forming element about an axis substantially corresponding to the axis of the first in-line forming element to provide fixed orbital movement.

15. The apparatus of claim 14 wherein said means for shifting said forming elements is sufficient to provide a crimping operation for said leading and trailing edges of the blank to obviate the tendency for flats in these locations.

16. The apparatus of claim 1 wherein is further provided a plurality of vertically extending bed plates and aligned superstructure frame plates to form the frame for said apparatus, tie means extending along the length of said apparatus to tie said plates together, and means for adjusting the superstructure with respect to the bed to provide opening of the machine for release of the finished tube and for adjustment of the thickness of the blank.

17. The apparatus of claim 16, wherein said means for adjusting the position of said superstructure includes a toggle link mechanism with an adjustable link along the front of said apparatus, and an adjustable pivot pin adjacent the rear of the apparatus.

18. The apparatus of claim 16 wherein said blank is positioned between the superstructure and the bed by idler guide rollers to prevent buckling of said plate as the blank is moved between said forming elements.

19. The apparatus of claim 1 wherein is further provided means for loading said blank into said machine from one end, and means for unloading the finished tube from the opposite end of said apparatus.

20. The apparatus of claim 19, wherein said loading means includes a plurality of rollers positioned along the path of travel of the blank, means for retracting said rollers to provide positioning of said blank for forming and means for driving said rollers to provide the in-feed function.

21. The apparatus of claim 20, wherein said loading rollers are positioned to urge the blank toward the front of the apparatus, and retractable guide means for positioning the leading edge of the blank between said forming elements in readiness for the forming operation.

22. The apparatus of claim 19 wherein is further provided retractable roller means for positioning under the finished tube and means for driving at least one of said roller means to move the tube out of said apparatus.

23. The apparatus of claim 22 wherein said unloading rollers are retractable by linear motor means.

24. The apparatus of claim 7 wherein said roll segments are mounted on the inner tip of said support arms and wherein is further provided a plurality of adjustable guide rollers over said cantilever support arms and positioned to limit the outward movement of said tubular article during compressive deflection and means to adjust the position of said guide rollers.

25. The apparatus of claim 24 wherein is further provided linear motor means connected to the last in-line guide roller defining the guide chamber so as to move against the tube during the forming process.

26. Apparatus for forming a substantially closed elongated tubular article without the use of an internal mandrel from a flat metal blank comprising an inner roll element and two outer roll elements forming a pyramid roll assembly, the diameter of at least said inner roll element not exceeding approximately five times the thickness of said blank to form a curved arc along the entire length of the blank, and means to move said blank between said roll elements to progressively bend said blank along the substantially curved arc to form the tubular article, and means to guide and compressively deflect said tubular article into a spiral after being formed within the elastic limit of the article by guiding a leading edge of said article over said inner roll element, whereby upon release of said article by said guiding and deflecting means full formation of a closed cross-section in said tube is assured.

27. The apparatus of claim 26 wherein said upper roll element is provided in independently supported segments, said segments being spaced sufficiently close to provide continuous bending along the full length of said tubular article.

28. The apparatus of claim 27 wherein each of the roll segments is mounted on a separate cantilever arm.

29. The apparatus of claim 26 wherein said means to guide and deflect said article comprises a cantilever arm, said arm mounting said inner roll element.

30. The apparatus of claim 26 wherein said moving means is provided by pusher means to engage the trailing edge of the blank being formed, aligned upper and lower frame plates forming a movement path for the blank means to confine the blank along said path to prevent buckling of the blank and means for raising the upper frame plates to load said blank means and to release the tubular article for unloading.

31. The apparatus of claim 30 wherein said pusher means comprises a plate mounted for sliding movement along the lower frame members, a pusher head including a pusher blade to provide engagement with the trailing edge of said blank, a saddle for supporting said pusher head and resilient means between said saddle and said pusher head to absorb shock and accommodate slight variations along said edge.

32. The apparatus of claim 31 wherein said pusher means further includes linear motor means having a jack screw for moving said saddle and through said resilient means moving said pusher head to push said blank.

33. The apparatus of claim 26 wherein the lower roll elements are carried by cradle rollers so as to be free floating, cradle means for carrying the cradle rollers and pivoted about the first in-line roll element, lever means for rotating said cradle, and linear motor means for operating said lever to adjust the position of the second in-line roll element in an arc about the first roll element.

34. The method for forming a substantially closed elongated tubular article comprising the steps of providing a flat blank, feeding said blank into a forming assembly including a cantilever mounted inner forming element and at least one outer element, adjusting at least said one of said outer elements to provide the desired tube size, pushing the blank from the trailing edge while confining the blank in a path of movement aligned with the forming elements to progressively bend said blank along a substantially curved arc to form the tube, and compressively deflecting the tubular article into a spiral within the limit of elastic recovery by guiding a leading edge of said article over the cantilever mounted inner forming element whereby upon release of said article after said deflecting step full formation of a closed cross section in said tube is assured.

35. The method of forming a tubular article of claim 34 wherein said forming assembly includes pyramid rolls and said forming elements are rolls and wherein is provided the additional step of adjusting said inner roll element to assist in forming the leading and trailing edges of said blank.

36. The method of claim 35 wherein is further provided the step of raising the finished tubular article over said lower roll elements and axially driving said tubular article for unloading.

37. The method of claim 35 wherein is further provided the step of dynamically moving said inner roll element and at least one of said lower roll elements during movement of the blank to form the edges and any desired arc in said tubular article.

38. The method of claim 37 wherein two outer in-line rolls are provided and said upper roll element is moved parallel to the unformed blank and the second in-line roll element is pivoted about the axis of said first in-line roll element.

39. The method of claim 34 wherein is further provided the steps of providing a blank greater in width than the circumference of the tubular article being formed and continuing the pushing step until at least a portion of said article is formed with a multiple wall.

40. The method of claim 39 wherein the pushing step is continued so as to form substantially two full wall thicknesses to provide a double-walled tubular article.

* * * * *